US009839938B2

(12) United States Patent
Picard et al.

(10) Patent No.: US 9,839,938 B2
(45) Date of Patent: Dec. 12, 2017

(54) DEVICE FOR CARRYING OUT A DEPOSIT OF PARTICLES ON A SUBSTRATE AND DEPOSITION METHOD USING SUCH A DEVICE

(71) Applicants: Commissariat à l'Energie Atomique et aux Energies Alternatives, Paris (FR); CNRS, Paris (FR); UNIVERSITE JOSEPH FOURIER—GRENOBLE, Grenoble (FR)

(72) Inventors: Emmanuel Picard, Saint Martin d'Uriage (FR); Julien Cordeiro, Varennes-le-Grand (FR); Kévin Berton, Grenoble (FR); David Peyrade, Moirans (FR); Marc Zelsmann, Meylan (FR)

(73) Assignees: COMMISSARIAT A L'ENERGIE ATOMIQUE ET AUX ENERGIES ALTERNATIVES, Paris (FR); CNRS, Paris (FR); UNIVERSITE JOSEPH FOURIER-GRENABLE, Grenoble (FR)

( * ) Notice: Subject to any disclaimer, the term of this patent is extended or adjusted under 35 U.S.C. 154(b) by 16 days.

(21) Appl. No.: 14/706,253

(22) Filed: May 7, 2015

(65) Prior Publication Data

US 2015/0321216 A1 Nov. 12, 2015

(30) Foreign Application Priority Data

May 8, 2014 (FR) ..... 14 54166

(51) Int. Cl.
*B05D 1/12* (2006.01)
*B05B 9/03* (2006.01)
(Continued)

(52) U.S. Cl.
CPC ..... *B05D 1/12* (2013.01); *B05B 9/03* (2013.01); *B05C 3/18* (2013.01); *B05C 19/00* (2013.01);
(Continued)

(58) Field of Classification Search
None
See application file for complete search history.

(56) References Cited

U.S. PATENT DOCUMENTS 6,068,878 A 5/2000 Alwan
2005/0129867 A1* 6/2005 Picard ..... B01D 69/122 427/434.3
(Continued)

FOREIGN PATENT DOCUMENTS

WO 2008/014604 A1 2/2008
WO WO 2014/066862 A2 * 5/2014 ..... B05C 3/02

OTHER PUBLICATIONS

French Preliminary Search Report and Written Opinion dated Jan. 21, 2015, issued in corresponding application No. FR1454166; with English partial translation and partial machine-translation.

*Primary Examiner* — Dah-Wei D Yuan
*Assistant Examiner* — Jethro M Pence
(74) *Attorney, Agent, or Firm* — Westerman, Hattori, Daniels & Adrian, LLP

(57) ABSTRACT

Device (10) for depositing particles via the liquid route including a first chamber a second chamber (12), a communication hole between the first chamber (11) and the second chamber (12), and a vent which is provided in the second chamber and which places the second chamber and a medium (200) which is external with respect to the device in communication.

19 Claims, 2 Drawing Sheets

(51) Int. Cl.

| | |
|---|---|
| ***B05C 19/00*** | (2006.01) |
| ***B05C 3/18*** | (2006.01) |
| ***B05D 1/26*** | (2006.01) |
| *B05D 1/18* | (2006.01) |

(52) U.S. Cl.
CPC ..... *B05D 1/26* (2013.01); *B05D 1/18* (2013.01); *Y10T 428/31504* (2015.04)

(56) References Cited

U.S. PATENT DOCUMENTS

| | | | | |
|---|---|---|---|---|
| 2011/0135834 | A1* | 6/2011 | Schneider | B05C 9/02 427/420 |
| 2011/0159700 | A1 | 6/2011 | Yeh | |
| 2012/0040164 | A1* | 2/2012 | Lee | B05D 1/20 428/220 |
| 2012/0171448 | A1 | 7/2012 | Akey et al. | |

* cited by examiner

DEVICE FOR CARRYING OUT A DEPOSIT OF PARTICLES ON A SUBSTRATE AND DEPOSITION METHOD USING SUCH A DEVICE

The invention relates to the field of distributing particles on a surface. The invention particularly relates to a depositing device for particles via the liquid route or a device for depositing particles via the liquid route. The invention further relates to a method for depositing particles via the liquid route. Finally, the invention relates to a product obtained by the method according to the invention.

It is known to deposit on a surface particles in suspension in a liquid. It is possible to deposit some liquid on the surface then to evaporate the liquid.

However, it is complex to deposit particles on surfaces in a repeatable manner according to this method. This is because the quantity of particles deposited depends on the method of depositing the liquid. In order to control this quantity, it is necessary to deposit a calibrated volume of this liquid in order always to have the same quantity of material available in order to fill structures of a structured substrate with the particles.

When the volumes of liquid to be deposited are small and when the sizes become small, phenomena of capillarity become dominant and complicate matters.

An object of the invention is to provide a device for depositing particles via the liquid route, improving the devices known from the prior art. In particular, the invention proposes a simple device which allows operations for depositing particles via the liquid route which are repeatable, reliable and precise.

According to the invention, the device for depositing particles via the liquid route comprises:

- a first chamber,
- a second chamber,
- a communication hole between the first chamber and the second chamber and
- a vent which is provided in the second chamber and which places the second chamber and a medium which is external with respect to the device in communication.

The vent and the communication hole may be arranged opposite each other in the second chamber or substantially opposite each other in the second chamber and/or the vent and the communication hole may be arranged on two opposing or substantially opposing walls of the second chamber.

The first chamber and the second chamber may have a first wall and a second wall which are arranged one in continuation of the other, respectively. The first chamber and the second chamber may have in particular a common ceiling.

The first chamber may be parallelepipedal or substantially parallelepipedal and/or the second chamber may be parallelepipedal or substantially parallelepipedal.

The volume of the first chamber may be less than the volume of the second chamber, or the volume of the first chamber may be less than half of the volume of the second chamber, or the volume of the first chamber may be less than one-third of the volume of the second chamber.

The height of the first chamber may be less than the height of the second chamber, or the height of the first chamber may be less than half of the height of the second chamber, or the height of the first chamber may be less than one-third of the height of the second chamber.

The device may comprise a base and a cover which is removable and/or fitted to the base.

The device may be produced from a silicone-based material, in particular PDMS.

The volume of the first chamber may be approximately from 30 to 40 $mm^3$ and/or the volume of the second chamber may be approximately 100 $mm^3$.

According to the invention, the method for depositing particles on a surface of a substrate comprises the use of a device defined above.

The method may comprise the following steps,

- positioning the device on the surface of the substrate;
- supplying the first chamber with a liquid charged with particles, in particular through a wall of the first chamber;
- evaporating the liquid.

The step of supplying the first chamber with a liquid charged with particles may be carried out by means of a tool, in particular a needle, the end diameter of which is less than the height of the first chamber.

The invention also relates to a product obtained by carrying out the method defined above.

The invention will be better understood from a reading of the following description given purely by way of example and with reference to the appended drawings, in which.

Figure 1:
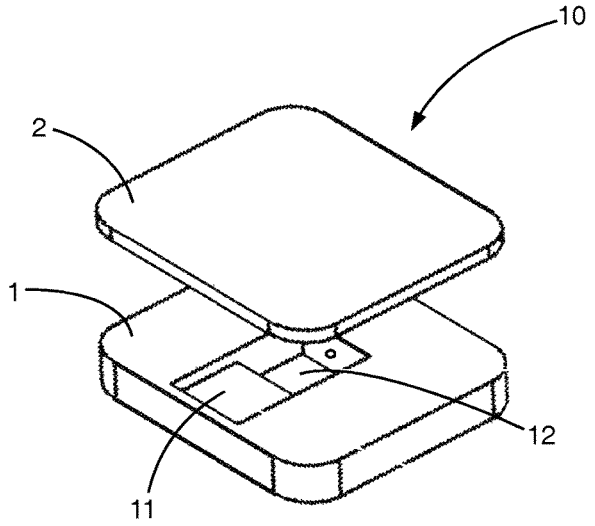
FIG. 1 is an exploded perspective view of a first embodiment of the device according to the invention.
Figure 2:
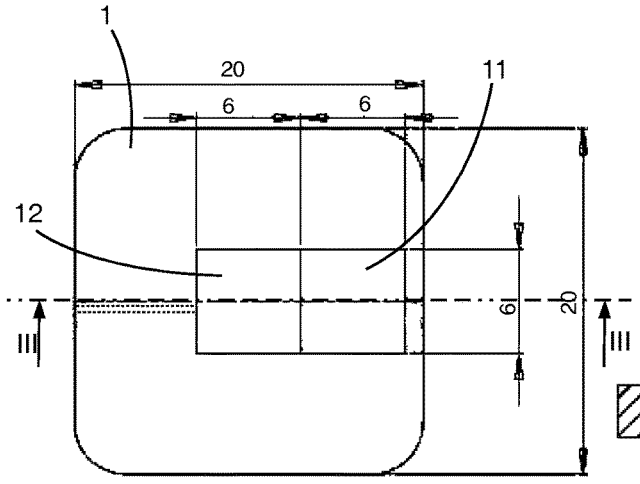
FIG. 2 is a top view of the base of the device according to the first embodiment, the dimensions being indicated in mm.
Figure 3:
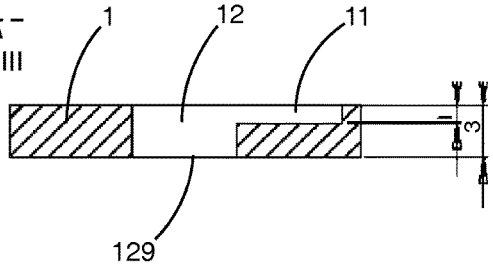
FIG. 3 is a cross-section taken along the plane III-III of the base of the device according to the first embodiment.
Figure 5:
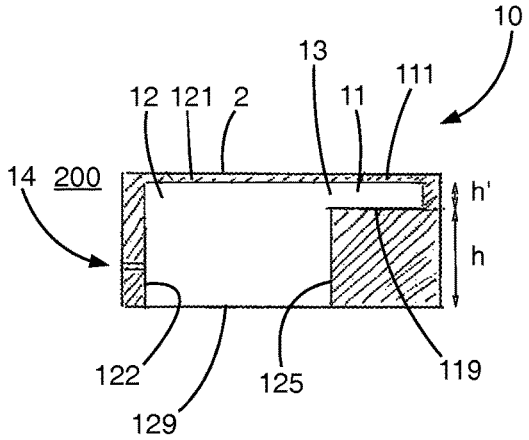
FIG. 5 is a cross-section of the device according to the second embodiment.
Figure 4:
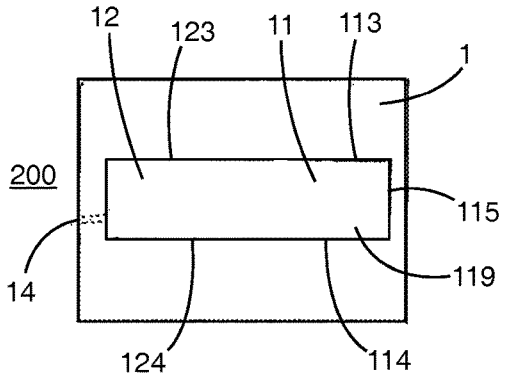
FIG. 4 is a top view of the device according to a second embodiment of the invention.

A first embodiment of a device 10 for depositing particles via the liquid route according to the invention is described below with reference to FIGS. 1 to 3. A second embodiment of a device 10 for depositing particles via the liquid route according to the invention is described below with reference to FIGS. 4 and 5. The two embodiments differ from each other only as a result of dimensional characteristics and the presence of a cover 2 which is removable or fitted to a base 1 in the first embodiment, or a cover either being fixed to the base or being monobloc with respect to the base in the second embodiment.

The device 10 comprises:

- a first chamber 11,
- a second chamber 12,
- a communication hole 13 or channel or passage between the first chamber 11 and the second chamber 12 and
- a vent 14 which is provided in the second chamber and which places the second chamber and a medium 200 which is external with respect to the device in communication.

The external medium is the ambient atmosphere, in particular ambient air. The vent is arranged in a vertical wall of the second chamber which is not intended to come into contact with a liquid which will be injected into the chambers.

The first and second chambers which are connected via the communication hole therefore form a single cavity.

The communication hole may not have a cross-section having a surface-area smaller than the one which the chamber having smaller dimensions has, at least in the region of the hole.

As set out above, the first chamber and the second chamber are constructed in the device, in particular in the base 1. The cover 2 closes the first chamber and the second chamber at one side of the device. At the other side of the device, the second chamber has an opening 129 which is intended to be closed by a surface 101 of a substrate which is intended to be processed as described below, that is to say, a surface on which particles have to be deposited. The first chamber and the second chamber advantageously have a first cover wall 111 and a second wall 121 which are arranged one in continuation of the other, respectively. In this manner, the cover may form a ceiling 111, 121 common to the first chamber and the second chamber.

Preferably, the vent and the communication hole are arranged opposite each other in the second chamber or substantially opposite each other in the second chamber. In particular, the vent and the communication hole may be arranged on two opposing or substantially opposing walls 122, 125 of the second chamber, in particular walls which are parallel or substantially parallel. The advantage of such an arrangement or configuration will be set out below.

For example, the first chamber is parallelepipedal or substantially parallelepipedal and/or the second chamber is parallelepipedal or substantially parallelepipedal. For example, the first chamber has a bottom 119 and lateral walls 113, 114 and 115. For example, the second chamber has lateral walls 122, 123, 124 and 125.

The volume of the first chamber is less than the volume of the second chamber. The volume of the first chamber may in particular be less than half of the volume of the second chamber, or the volume of the first chamber may be less than one-third of the volume of the second chamber. In particular, the volume of the first chamber is approximately from 30 to 40 $mm^3$ and/or the volume of the second chamber is approximately 100 $mm^3$. With the dimensions of the chambers of the device of FIG. 3, the volume of the first chamber is 36 $mm^3$ and the volume of the second chamber is 108 $mm^3$. It is evident that larger volumes may be implemented using chambers which cover surface-areas which may be up to several hundreds of $cm^3$ and on which particles have to be deposited.

The height h' of the first chamber is preferably less than the height h of the second chamber, or the height h' of the first chamber is less than half of the height h of the second chamber, or the height h' of the first chamber is less than one-third of the height h of the second chamber. For example, h is 3 mm and h' is between 0.5 mm and 1.5 mm, in particular 1 mm.

The second chamber is connected to the first chamber via the hole 13, having a cross-sectional surface-area which is one-third of the surface-area of a side of the second chamber, to which the first chamber is connected. The first chamber may have the same width as the second chamber and/or the upper walls 111, 121 thereof may be co-planar.

The device is preferably produced from a silicone-based material, in particular PDMS (or polydimethylsiloxane). The horizontal faces, that is to say, the cover, may be produced from glass.

The device may be produced, for example, by moulding PDMS in an aluminium mould. Other materials may be used but the wettability of those materials by the liquid used must be similar to that of the PDMS by water.

One manner of carrying out a method for depositing particles on a surface 101 of a substrate 100 is described below with reference to FIGS. 6 and 7.

The method comprises the use of a device as defined or described above.

Figure 6:
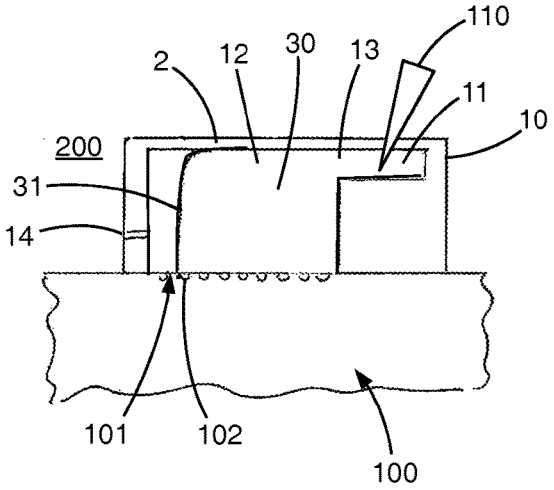
FIG. 6 is a cross-section of the device according to the second embodiment, the device being used in order to carry out a first step of carrying out a deposition method according to the invention.
Figure 7:
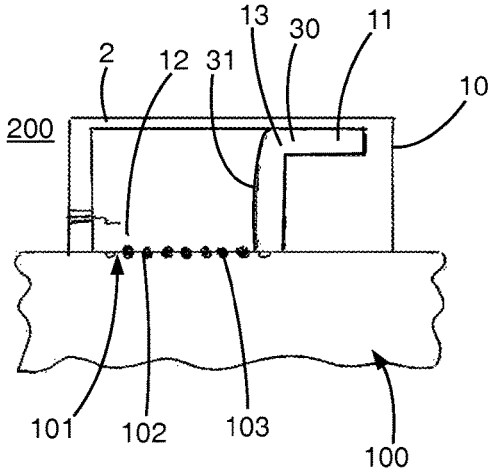
FIG. 7 is a cross-section of the device according to the second embodiment, the device being used to carry out a second step of carrying out a deposition method according to the invention.

The deposition method comprises the following steps,

- positioning the device 10 on the surface 101 of the substrate 100, as illustrated in FIG. 6;
- supplying the first chamber 11 with a liquid 30 charged with particles, in particular through a wall 111 of the first chamber, as illustrated in FIG. 6;
- evaporating the liquid, as illustrated in FIG. 7.

The step of supplying the first chamber 11 with a liquid 30 charged with particles is carried out by means of a tool 110, in particular a needle, the diameter of the end of which is advantageously less than the height h' of the first chamber 11.

Once the device has been positioned on the surface of the substrate on which the particles have to be deposited, it is first necessary to fill the first chamber, then the filling action is continued in the second chamber, the liquid introduced into the first chamber travelling towards the second chamber via the hole 13. That filling is carried out by means of a tool which allows piercing of a wall of the first chamber, in particular the wall 111 or the wall 115. The filling is continued until coverage is provided of the surface 101 of the substrate on which particles have to be deposited and is stopped before the second chamber is completely filled, that is to say, before the wall 122 having the vent 14 is wetted. Therefore, the measure of liquid contained in the tool must be calibrated and less than the volume of the cavity formed by the first and second chambers. As a result of the phenomena of capillarity, the liquid progressively wets the walls 125, 101, 121, 123 and 124 during the filling action after being discharged via the hole 13 and the liquid front 31 progresses towards the wall 122, discharging the gas, in particular the air contained in the second chamber, via the vent 14.

As a result of the configuration of the device, it is impossible to impose wetting conditions on the liquid before it is introduced into the second chamber. The first chamber must be completely filled (or substantially filled; there may remain one or more air pockets) before the start of the filling of the second chamber. Therefore, the liquid will be distributed in the second chamber from the communication hole 13 and therefore only progressively wetting the surfaces of the second chamber, for example, progressively wetting five of the walls of the second chamber. The wall 122 having the vent 14 faces the liquid front but is not reached by the liquid, the volume of liquid being established or calibrated in order to prevent it from wetting that wall. The liquid front 31 may thus be formed substantially parallel with the wall 122. That effect is obtained by the arrangements relating to the vent and the communication hole in the second chamber. The vent and hole are, for example, arranged opposite each other or substantially opposite each other in the second chamber.

The first chamber may be filled without any constraint on the position of the tool 110 ensuring the filling operation, in particular the needle 110. The diameter of the end of the tool 110 is, for example, 0.5 mm. This tool allows the material of the device to be pierced in order to inject the liquid. The effect obtained is independent of the position of the injection. This is because, during the injection, the end of the tool may be perpendicular to the bottom 119 of the device. Alternatively, the end of the tool may be parallel with the bottom 119 of the device. The end of the tool may further occupy any intermediate configuration.

In order to promote or to allow the evaporation of the liquid as illustrated in FIG. 7, it is possible to carry out heating, in particular heating of the substrate 100 and/or of the device 10. During the evaporation, the liquid front 31 is moved towards the wall 125, the evaporation gas of the liquid being discharged via the vent 14. During discharge, the liquid front leaves on the walls and on the surface 101 of the substrate, in particular in structures or impressions 102 which are formed in the surface 101, a deposit 103 of particles which were previously in suspension in the liquid. In accordance with the density of particles in the liquid and in accordance with the shape and/or size of the structures, it is thereby possible to deposit the number of particles which is desired in each structure.

The vent can be coupled to an aspiration system. The control of the aspiration system may improve, in a state associated with the heating, the efficacy of the deposit of particles.

If particles have to be deposited on a large substrate surface, and if the cavity has a large volume, the device may comprise a plurality of vents. The vents are preferably distributed over the wall 125. It is also possible to dispense with the wall 125. The opening of the second chamber in this region constitutes a vent having large dimensions.

The device 10 may subsequently be withdrawn or removed. In other words, the device 10 may be removed or separated from the substrate. Thus, a product 100 or a substrate 100 produced by carrying out the method defined or described above is obtained. Therefore, a product 100 or a substrate 100 on which particles have been deposited is obtained.

As a result of the solution described above, it is possible to bring about an introduction of the tool which supplies the liquid which does not destroy or damage the substrate. When the desired quantity of liquid is established, the operation becomes reproducible because the quantity deposited will always be identical.

When a liquid is injected into a cell whose volume is similar to the volume of the injected liquid, it is very difficult to be deterministic regarding the faces which will be in contact with the liquid. As a result of the solution described above, it is thus possible to inject a liquid into a closed volume, for example, of parallelepipedal form, with a tool in a deterministic manner. The filling is reproducible and independent of the dexterity of the operator. It is known that only some predetermined walls of the second chamber will be wetted by the liquid. Finally, as a result of the geometry of the device, it is possible not to damage the walls of the second chamber or the surface of the substrate (by puncturing the wall or the surface).

Depositing particles on a surface may allow the subsequent analysis of the particles and/or the characterisation thereof. Depositing particles on a surface may allow a functionalisation of the surface, wherein the particles fulfil a predetermined function, in particular a function which they fulfil intrinsically.

In this document, the term "vent" is intended to be understood to be any opening or passage or any assembly of openings or passages allowing gas to be discharged.

The invention claimed is:

1. A device for depositing particles via a liquid route comprising:

a first chamber, a second chamber, the second chamber having an opening configured to be closed by a surface of a substrate on which particles are configured to be deposited, a communication hole between the first chamber and the second chamber, and a vent which is provided in the second chamber and which places the second chamber in communication with a medium which is external to the device, wherein the vent and the communication hole are arranged opposite each other in the second chamber relative to the opening in the second chamber, so as to enable the vent to face a liquid front discharged from the communication hole, without the vent being reached by the liquid.

2. The device according to claim 1, wherein the vent and the communication hole are arranged on two opposing walls of the second chamber relative to the opening in the second chamber.

3. The device according to claim 1, wherein the first chamber and the second chamber have a first wall and a second wall which are arranged one in continuation of the other, respectively.

4. The device according to claim 1, wherein at least one of (i) the first chamber is parallelepipedal so as to enable to fill a determined volume of liquid into the first chamber in a reproducible manner, and (ii) the second chamber is parallelepipedal so as to enable the vent to face a liquid front that progressively wets surfaces of walls of the second chamber after being discharged from the communication hole, without a wall of the second chamber on which the vent is provided being reached by the liquid.

5. The device according to claim 1, wherein a volume of the first chamber is less than a volume of the second chamber.

6. The device according to claim 1, wherein a height of the first chamber is less than a height of the second chamber.

7. The device according to claim 1, wherein the device comprises a base and a cover which is at least one of (i) removable and (ii) fitted to the base.

8. The device according to claim 1, wherein the device is produced from a silicone-based material.

9. A method for depositing particles on a surface of a substrate, comprising depositing particles on the surface using a device for depositing particles via a liquid route, the device comprising:

a first chamber, a second chamber, the second chamber having an opening configured to be closed by a surface of a substrate on which particles are configured to be deposited, a communication hole between the first chamber and the second chamber, and a vent which is provided in the second chamber and which places the second chamber in communication with a medium which is external to the device, wherein the vent and the communication hole are arranged opposite each other in the second chamber relative to the opening in the second chamber, so as to enable the vent to face a liquid front discharged from the communication hole, without the vent being reached by the liquid.

10. The method according to claim 9, comprising:

positioning the device on the surface of the substrate;

supplying the first chamber with a liquid charged with particles; and evaporating the liquid.

11. The method according to claim 10, wherein the supplying of the first chamber with the liquid charged with particles is carried out by means of a tool having an end diameter of less than a height of the first chamber.

12. The device according to claim 3, wherein the first chamber and the second chamber have a common ceiling.

13. The device according to claim 5, wherein the volume of the first chamber is less than half of the volume of the second chamber.

14. The device according to claim 13, wherein the volume of the first chamber is less than one-third of the volume of the second chamber.

15. The device according to claim 6, wherein the height of the first chamber is less half of the height of the second chamber.

16. The device according to claim 15, wherein the height of the first chamber is less than one-third of the height of the second chamber.

17. The device according to claim 8, wherein the device is produced from polydimethylsiloxane.

18. The method according to claim 10, wherein the supplying of the first chamber with the liquid charged with particles is carried out through a wall of the first chamber.

19. The method according to claim 11, wherein the tool is a needle.

* * * * *